United States Patent [19]

Terracol et al.

[11] Patent Number: 4,695,913

[45] Date of Patent: Sep. 22, 1987

[54] SHUNT EFFECT LOW VOLTAGE CIRCUIT BREAKER

[75] Inventors: Claude Terracol; Jean-Pierre Roulet-Dubonnet, both of Eybens, France

[73] Assignee: Merlin Gerin, Grenoble, France

[21] Appl. No.: 864,878

[22] Filed: May 20, 1986

[30] Foreign Application Priority Data

May 29, 1985 [FR] France ..... 85 08178

[51] Int. Cl.[4] ..... H01H 9/38; H01H 9/40

[52] U.S. Cl. ..... 361/13; 361/2; 200/144 R

[58] Field of Search ..... 361/2, 3, 8, 9, 10, 361/12, 13, 14, 102, 115; 200/144 R; 335/8, 9, 10, 11, 12, 15, 16

[56] References Cited

U.S. PATENT DOCUMENTS 2,924,752 2/1960 Scott, Jr. ..... 361/12
4,314,300 2/1982 Griffith ..... 361/13

FOREIGN PATENT DOCUMENTS 0042778 12/1981 European Pat. Off. .
2259431 1/1975 France .
2360977 4/1976 France .

*Primary Examiner*—A. D. Pellinen
*Assistant Examiner*—H. L. Williams
*Attorney, Agent, or Firm*—Parkhurst & Oliff

[57] ABSTRACT

A circuit breaker, notably breaking the phase and neutral circuit, contains a shunt circuit, constituted by a switching electrode disposed in proximity to the phase contacts to pick up an arc drawn between these contacts, when opening occurs on a short-circuit. Transferring the arc onto the switching electrode closes a shunt circuit, creating an internal short-circuit protecting the cables and receivers downstream from the circuit breaker. The shunt circuit is broken when the arc is blown out in the arc chute. Fast shifting of the arc protects the contact surfaces, notably of the neutral contacts, enabling these contacts to be used for an impulse relay or remote-controlled contactor function.

8 Claims, 9 Drawing Figures

SHUNT EFFECT LOW VOLTAGE CIRCUIT BREAKER

The invention relates to a shunt effect circuit-breaker.

BACKGROUND OF THE INVENTION

U.S. Pat. No. 2,924,752 describes a shunt effect three-pole circuit breaker, which provides effective protection of cables and receivers downstream from the circuit breaker by creating a short-circuit internal to the circuit breaker when the latter opens. The short-circuit occurs on the three phases and the three pairs of contacts are subjected to the short-circuit current and are equipped with arc chutes. A circuit breaker of this kind is of limited value.

The present invention is based on the observation that the shunt effect protecting cables can be used in certain cases for protection of circuit breaker parts, which can then be simplified or designed to perform additional functions.

SUMMARY OF THE INVENTION

The circuit breaker according to the invention is characterized by the fact that it comprises a second operating mechanism for opening and closing of a second pair of contacts, disposed to give said second pair of contacts an electrodynamic withstand notably lower than that of said first pair of contacts, said circuit breaker being two-pole.

The invention is described hereafter as being applied to a circuit breaker protecting a single-phase installation, supplied by phase and neutral, but it can be applied to two-phase installations.

Shifting of the arc onto the electrode causes an actual short-circuit of greater intensity than that of the downstream short-circuit, but it offers the advantage of shunting this downstream circuit and of providing effective protection of the installation receivers and circuit breaker components downstream from the shunted circuit. The shunt circuit connects the phase and neutral input terminals directly and comprises only the arc chute associated with the phase contacts, so as to protect the circuit breaker neutral contacts by means of a judiciously dimensioned impedance. It should be noted that only opening on a short-circuit causes an arc sufficiently strong to be diverted onto the electrode creating the short-circuit in the shunt circuit. When the circuit breaker is opened by a manual operation, in order to break the rated current or slightly greater, the arc or spark is extinguished before being diverted onto the electrode. The electrodynamic withstand of the neutral contacts can be notably lower than that of the phase contacts and they can be simplified and actuated by an elementary mechanism.

The neutral contacts can be used to achieve a remote control or a contactor by actuating the mechanism by means of an electromagnet.

The switching electrode can be associated with a stationary phase contact, that is to say arranged to pick up the arc root drawn onto the stationary contact or inversely be associated with the moving contact, operation being of course identical. By taking care to open the neutral contacts slightly after the phase contacts, and possibly by closing them just before the phase contacts close, any risk of bonding of the neutral contacts, which are prefectly protected by the shunt circuit, is avoided, and it is possible to reduce the contact pressure and to eliminate the moving neutral contact extraction device ensuring its fast opening, as well as the arc chute. In the case of a remote-controled circuit breaker, eliminating the arc chute makes enough free space available to house the remote control electromagnet coil. The circuit breaker advantageously comprises two juxtaposed compartments or poles, one reserved for the phase circuit and the other for the neutral circuit. The remote control electromagnet is housed in the neutral circuit part, connection terminals of the control wires being disposed on this part. The invention can of course be used on a circuit breaker fitted with a remote control, the neutral contacts then being advantageously incorporated in an available space in the phase pole. The connection between the phase and neutral pole can advantageously be performed by coupling two handles.

The invention applies to a circuit breaker whose phase and neutral poles are independent, the neutral contacts for example serving only a remote control purpose. The casing is advantageously of the modular miniature type.

The circuit breaker according to the invention is associated or comprises a contactor, for example solid-state, connected in series or incorporated in the circuit breaker to constitute the neutral contacts, to open and close the distribution circuit in normal operation, said contactor being protected by the shunt circuit, in the event of a short-circuit. By incorporating the contactor in the circuit breaker, a device is produced which can easily be remote controled, while at the same time providing protection of the circuit controled. The contactor can be designed to perform a large number of operations, the shunt circuit instantaneously diverting any short-circuit current liable to damage the contactor, for example a triac or alternistor.

Perfection protection of the downstream circuit by the circuit breaker according to the invention makes a new type of circuit breaker opening order possible by creating or simulating a short-circuit. This short-circuit of course causes tripping of the circuit breaker by means of the electromagnetic release, with the shunt circuit coming into operation to protect the simulation circuit, which advantageously comprises a resistance limiting the short-circuit current to a value just high enough for instantaneous tripping of the circuit breaker. The simulation circuit sees the current for a very short time, which makes it possible to use simple components, for example a triac or thyristor, providing the simulation circuit opening or closing order. The order can come from an electronic circuit providing remote control or an additional protection, for example earth leakage protection. To this end, the circuit breaker includes a differential transformer measuring any unbalance between the phase current and the neutral current so as to emit a simulation circuit closing order signal, should an earth fault occur.

All these alternative embodiments can be intercombined according to the circuit breaker applications, which are almost universal.

BRIEF DESCRIPTION OF THE DRAWINGS

Other advantages and characteristics will become more clearly apparent from the following description of different embodiments of the invention, given as examples only and represented by the accompanying drawings, in which.

DESCRIPTION OF THE PREFERRED EMBODIMENT

Figure 2:
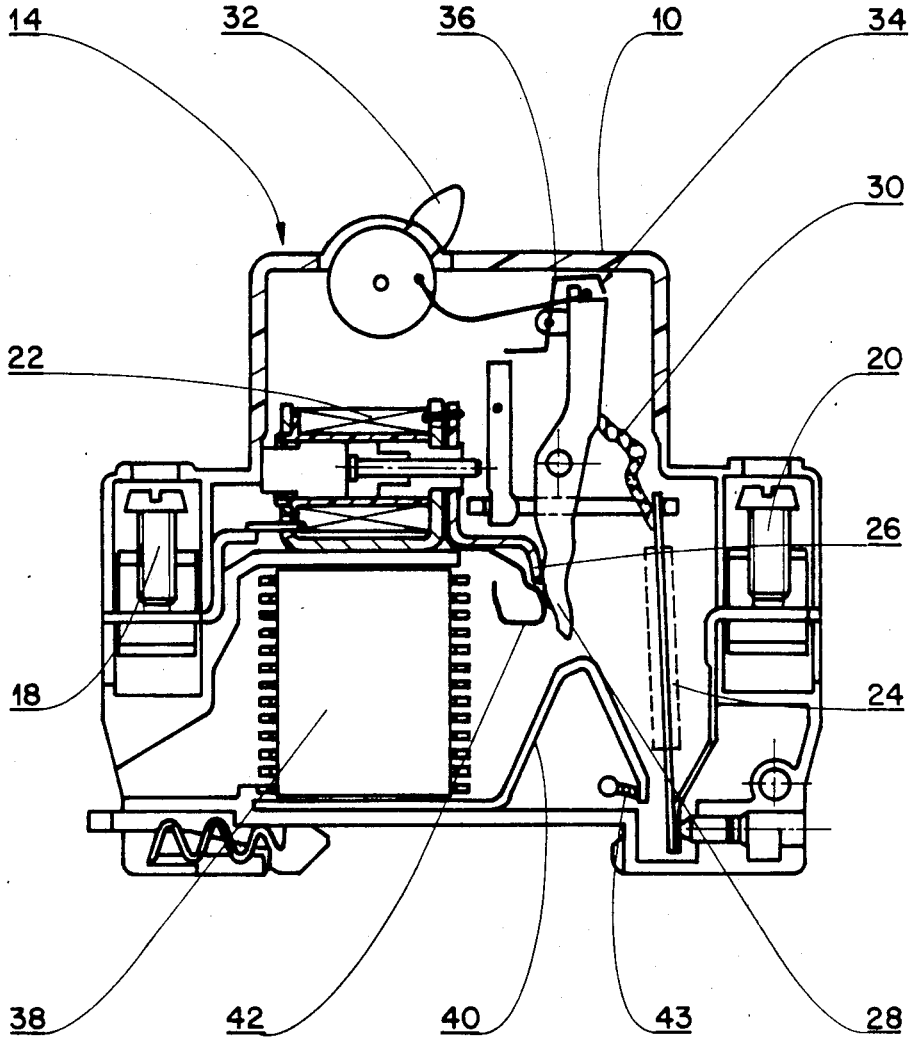

In the figures, a modular type miniature circuit breaker, commercially known as MULTI 9, comprises an insulated casing 10 which can be fixed onto a symmetrical DIN rail. The casing 10 can be subdivided into two compartments 12, 14, by a transverse partition 16 or be made up of two independent casings fitted side by side, notably two single-pole casings having a standard width of 18 mm. The compartment 14 houses the circuit breaker phase circuit, schematically represented in cross-section in FIG. 2. The overall layout corresponds to that described in U.S. patent application Ser. No. 680,465 now U.S. Pat. No. 4,604,507, issued Aug. 5, 1986 (the disclosure of which is herein incorporated by reference), but it is clear that the invention is applicable to any other type of circuit breaker. In FIG. 2, the input terminal 18 of the phase circuit can be seen with the output terminal 20 of this circuit on the opposite side. The electromagnetic release 22, the bimetallic strip 24, the stationary contact 26 and the moving contact 29 are also represented. The phase circuit comprises, connected in series, the input terminal 18, the magnetic release coil 22, the stationary contact 26, the moving contact 28, a connecting braid 30 to the bimetallic strip 24 and the output terminal 20. On the front of the casing 10, an operating handle 32 is located, to actuate a mechanism represented by the general reference 34 having a trip lock 36 which can be actuated by the release 22 and the bimetallic strip 24. An arc chute 38 is housed in the lower part of the casing 10, the bottom plate of the arc chute 38 being extended by an electrode 40 disposed in the form of an arcing contact 42 in the form of an elastic blade avoiding formation of an arc when the main contacts 26, 28, separate. It is not necessary to describe the operation of this assembly, the arc drawn between the contacts 28, 42, when separation occurs being rapidly diverted onto the electrode 40 and puffed in the arc extinction chamber or arc chute 38. The only notable difference with standard circuit breakers, notably the one described in the above-mentioned patent, is the lack of a connection between the electrode 40 and the output terminal 20. According to the invention, the electrode 40 is connected by a braid 43 to an input terminal 44 of the neutral compartment 12. The braid 43 passes for example through an orifice disposed in the separating partition 16 or the juxtaposed walls of the two casings, in the case of a modular system. The braid 43 can usefully be omitted if a single cut and folded part constitutes both the electrode 40 and the input terminal 44.

Figure 1:
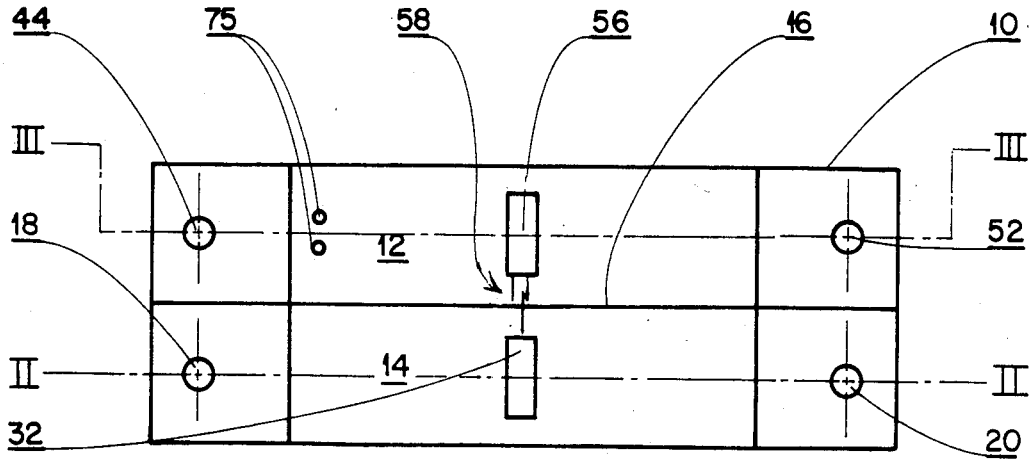
FIG. 1 is a plan view of a circuit breaker according to the invention.
Figure 3:
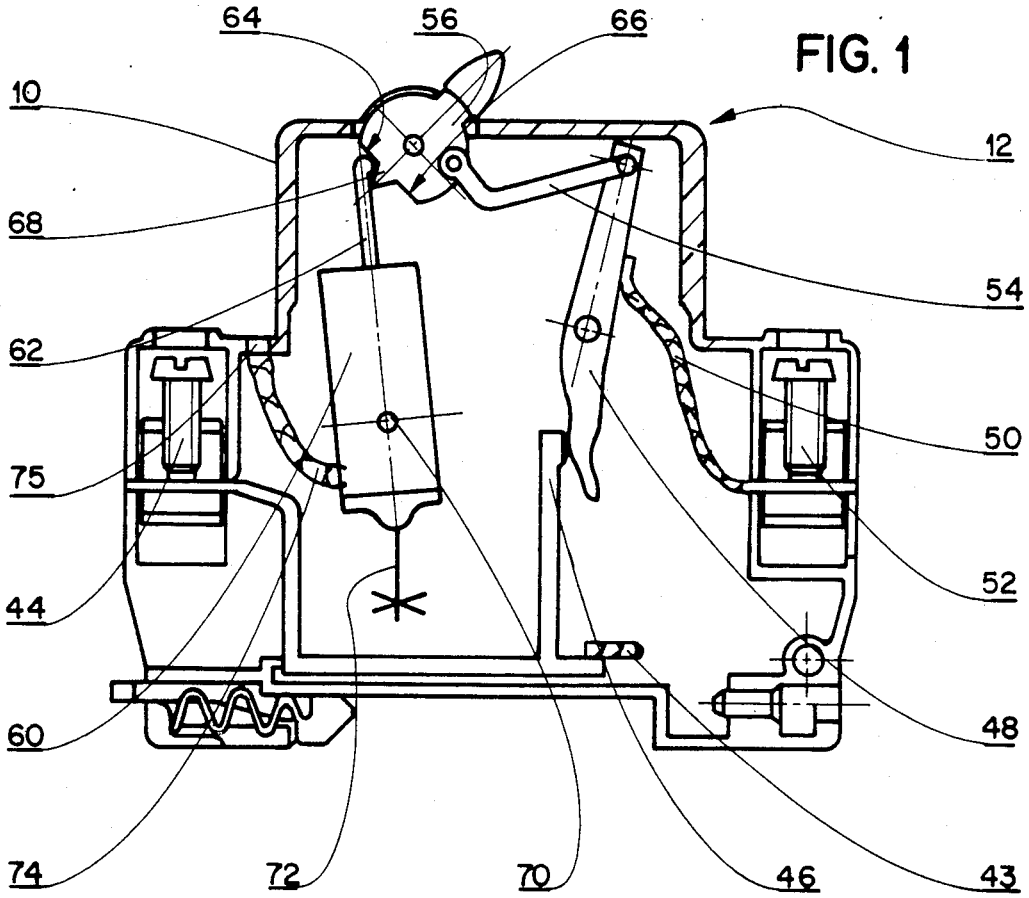
FIGS. 2 and 3 are cross-sections respectively along the lines II—II and III—III of FIG. 1.

Referring now to FIG. 3, which represents the neutral circuit, housed in the compartment 12, it can be seen that the neutral input terminal 44 is connected to the braid 43 and to a stationary contact 46 which operates in conjunction with a moving contact 48, connected by a braid 50 to the neutral output terminal 52. The moving contact 48 is connected by a bracket 54 to a manual operating handle 56 coupled by a slack link 58 to the adjacent handle 32. The mechanism, which is not described in detail, is arranged so that a pivoting of the handles 56, 32, causes separation of the phase contacts 46, 48. A reverse pivoting of the coupled handles 56, 32, causes closing of the neutral contacts 46, 48, before closing of the phase contacts 28, 26, 42. When a short-circuit occurs detected by the magnetic release 22, the latter releases the lock 36, allowing pivoting of the moving phase contact 28 due to the action of a spring (not shown) causing the contacts 28, 26, 42 to separate and an arc to form. The arc root anchored on the moving phase contact 28 rapidly shifts onto the electrode 40 causing closing of a shunt circuit comprising the braid 43. The current entering at a given moment via the phase input terminal 18 flows through the stationary contact 42, the arc extending between this contact and the electrode 40 and the braid 43 to flow out via the neutral input terminal 44 causing an internal short-circuit with a very short path. The shunt circuit is broken by extinction of the arc in the arc chute 38. It is clear that the receivers and cables supplied by the circuit breaker 10 are protected perfectly by the fast shifting of the arc and the transfer of the current to the shunt circuit. When the circuit breaker 10 is operated manually, under the circumstances to break the circuit when a current lower than or slightly higher than the rated current is flowing through it, the arc or spark drawn between the phase contacts 26, 28, 42, is extinguished before being transferred onto the electrode 40, which prevents a short-circuit occurring in normal operation or in the event of an overload.

An electromagnetic actuator 60 is housed in the compartment 12, for example in the location made free by omitting the arc chute and the magnetic release. This actuator 60 comprises a push-rod 62 which operates in conjunction with the stops 64, 66, disposed on the body of the handle 56. The stops 64, 66, are separated by a V-shaped protrusion 68 disposed in the middle part, pushing the push-rod 62 selectively to the left or to the right to cooperate selectively with the stops 64, 66. To this end, the actuator 60 is pivotally mounted on a pivot 70 and biased by an elastic blade 72 to the right-hand position. The actuator 60 comprises a coil (not shown) whose power supply wires 74 are connected to terminals 75 enabling the actuator 60 to be remote controled. The assembly formed by the actuator 60 and stops 64, 66, is of a well-known type in impulse relays enabling the handle 56 to be moved respectively to the right and to the left, at each fresh impulse, by energization of the coil of the actuator 60. For remote control, it is advantageous to remove the slack link 58 between the two operating handles 32, 56, so that only the neutral contacts are actuated. It is clear that the actuator 60 of the impulse relay type can be replaced by an actuator of the contactor type moving the handle or the mechanism of the circuit breaker 10 to the closed position when the actuator electromagnet is supplied, and moving the mechanism to the open position when the current supply to the actuator is broken. Mechanisms of this kind are well known in the art and do not require detailed description. The use of the circuit breaker as impulse relay or contactor is made possible due to the improved protection of the neutral contact surfaces, protected from the arc action by the shifting of the short-circuit current to the shunt circuit.

Figure 4:
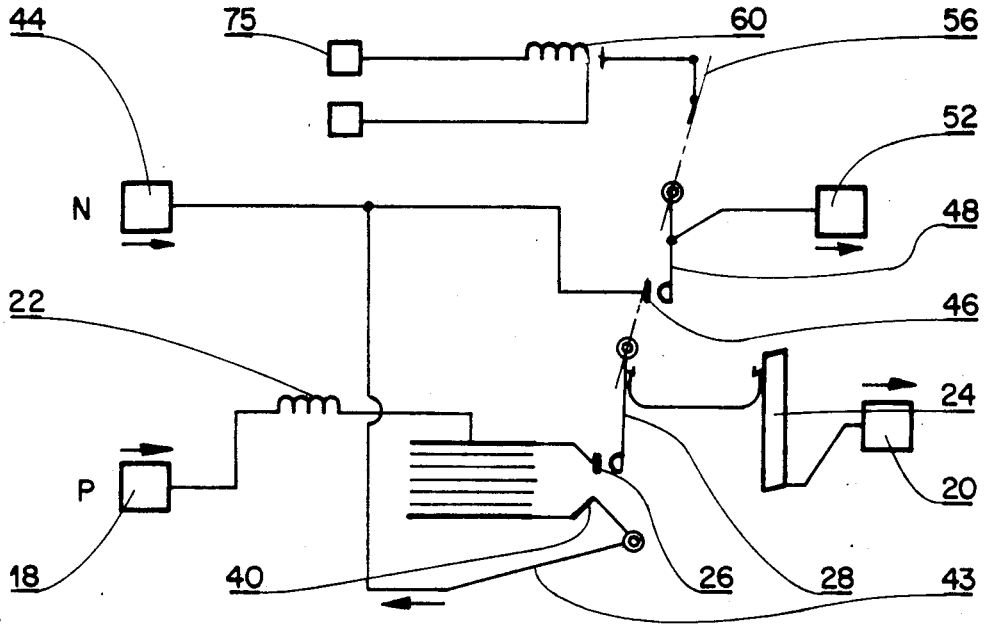
FIG. 4 represents the wiring diagram of the circuit breaker according to FIG. 1.
Figure 5:
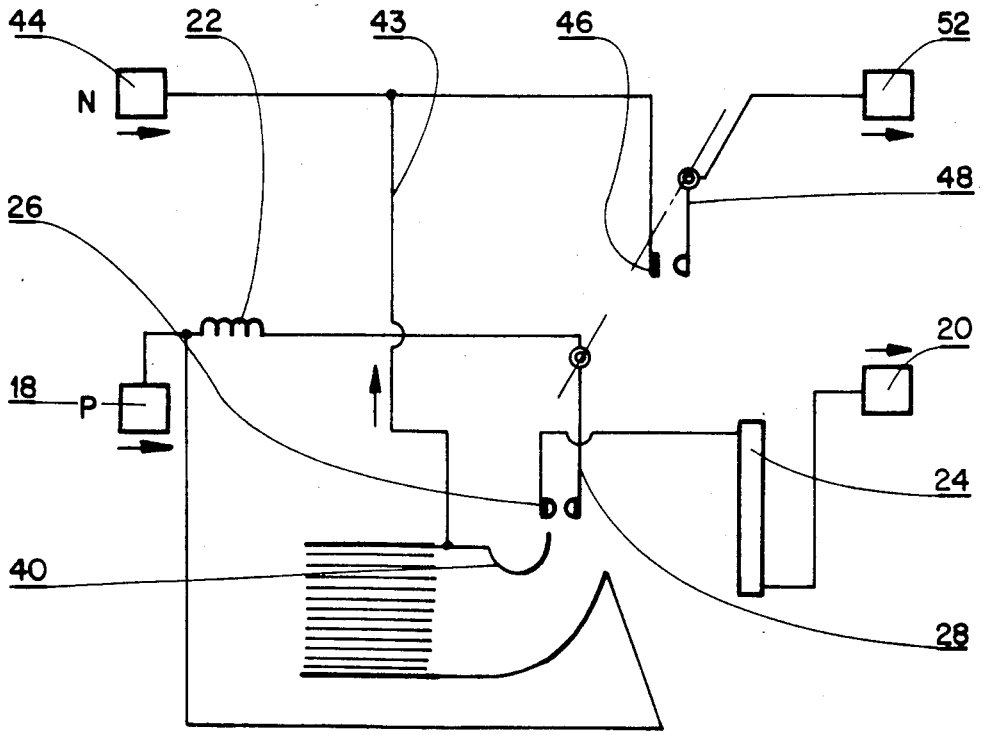
FIG. 5 is an identical view to that of FIG. 4, illustrating an alternative embodiment.

In the preferred embodiment, illustrated by FIGS. 1 to 4, the current is shifted to the shunt circuit by transferring the arc root anchored on the moving contact 28 to the switching electrode 40. It is clear that this diversion can be achieved in a different manner, notably by transferring the arc root anchored on the stationary contact 26 to an electrode 40 connected to the neutral input terminal 44. FIG. 5 illustrates an alternative embodiment of this kind which differs from that in FIG. 4 by a reversal of the connections of the stationary 26 and moving 28 phase contacts and by locating the electrode 40 in proximity to the stationary contact 26 to pick up the root anchored on the latter contact 26. Operation is naturally exactly the same as that described above. If it is desirable for a remote control to break the phase and the neutral, an additional contact operated like the neutral contact may be provided and inserted in the phase electrical circuit.

Another interesting alternative embodiment is to securedly unite the neutral contact to the phase contact, but electrically insulated from the latter and still fitted with an arc blowing system.

Figure 6:
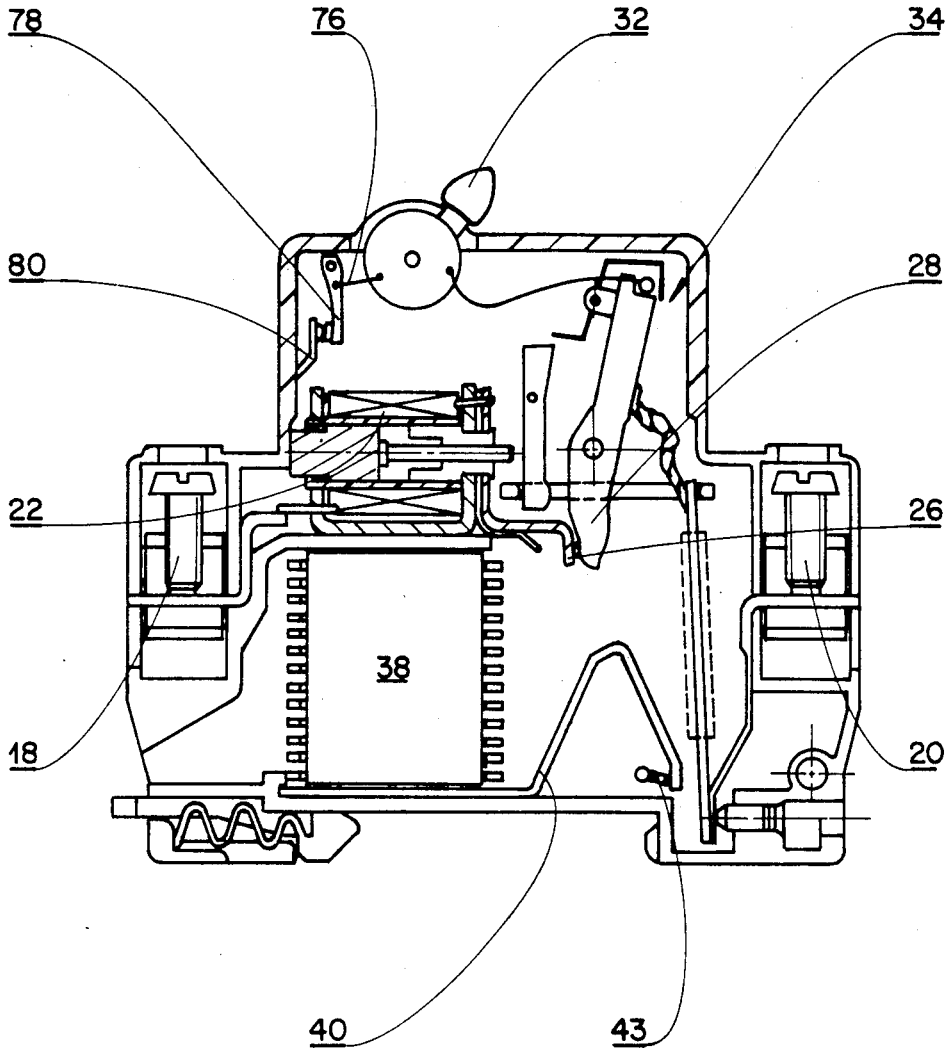
FIG. 6 is a similar view to that of FIG. 2, showing an alternative embodiment
Figure 7:
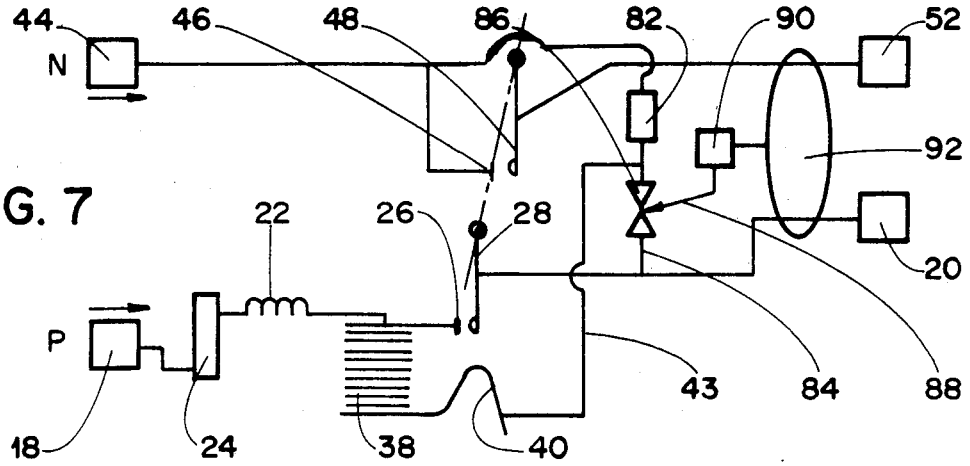
FIGS. 7, 8 and 9 are similar views to that of FIG. 4, illustrating three other alternative embodiments.

The invention can be used on a conventional circuit-breaker having phase contacts 26, 28, and neutral contacts 78, 80, as shown on FIG. 6. The neutral contacts 78, 80, are incorporated in the phase pole near the handle 32 and are electrically connected to terminals. A link 76 connects the neutral movable contact 78 to the handle 32. FIG. 7, which is similar to FIG. 4, illustrates an alternative embodiment wherein the shunt circuit 43 connects the electrode 40 to the neutral circuit via a resistance 82 limiting the short-circuit current. The value of the resistance 82 must be low to divert the majority of the current to the shunt circuit 43, the remainder flowing through the distribution circuit being sufficiently low not to damage the protected equipment. It is clear that this connection of the shunt circuit 43 can be used with a layout of the type represented in FIG. 5. In FIG. 7, a simulation circuit 84 is represented connecting the resistance 82 to the output terminal 20 of the phase circuit. An alternistor 86, for example a triac or any other semi-conductor controled by a trigger 88, is inserted in the simulation circuit 84. It can easily be seen that in the conduction position of the alternistor 86, for example controled by a signal applied to the trigger 88, a short-circuit is created between the phase circuit and the neutral circuit via the simulation circuit 84 and the resistance 82. This short-circuit is seen by the electromagnetic release 22 which causes the contacts 26, 28 to open, with fast shifting of the arc onto the electrode 40. As soon as the arc has been diverted onto the electrode 40, the simulation circuit 84 is shunted by the shunt circuit 43 and the current is borken in the manner described above in the arc chute 38. The trigger 88 receives the tripping orde by means of any suitable electronic circuit, notably in the manner illustrated in FIG. 7, by a relay 90 supplied by a differential transformer 92. This layout ensures earth leakage protection, the transformer 92 detecting any zero sequence fault and actuating the relay 90 which emits a signal applied to the trigger 88 to make the alternistor 86 conduct. Conduction of the alternistor 86 simulates a short-circuit which causes the circuit breaker to open.

Figure 8:
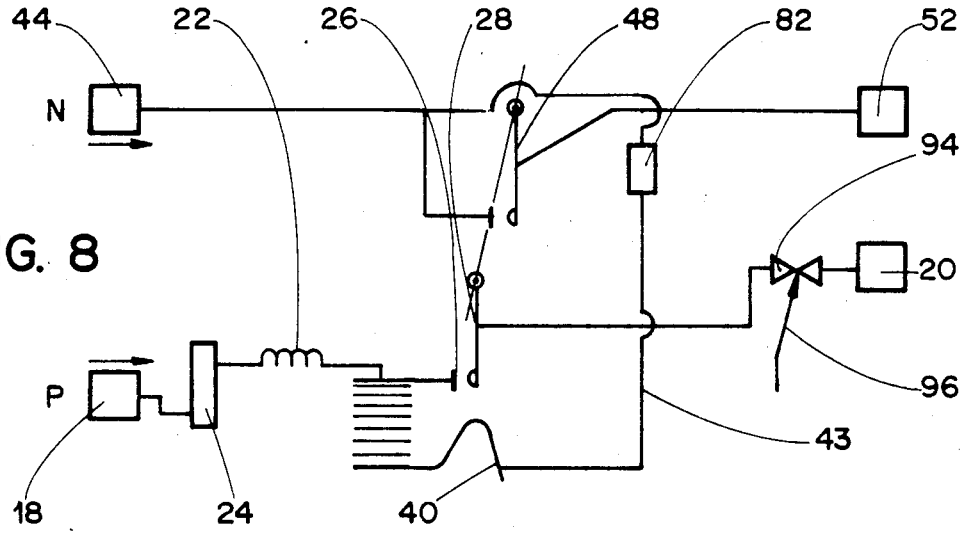

FIG. 8 represents the wiring diagram of another alternative embodiment comprising a shunt circuit 43 with a resistance 82 of the type illustrated in FIG. 7. In the phase circuit between the moving contact 28 and the output terminal 20, an alternistor 94 is disposed having a control trigger 96. It can be seen that the alternistor 94 is connected in series to the downstream distribution circuit connected to the output terminals 20, 52, in such a way that a blocking order to the alternistor 94 causes the power supply to this downstream circuit to be interrupted. Inversely, conduction of the alternistor 94 supplies this downstream circuit, the device operating as a contactor actuated by the signals applied to the trigger 96. When a short-circuit occurs downstream from the circuit breaker, the latter trips due to the action of the electromagnetic release 22 with formation of an arc between the phase contacts 26, 28, which separate. In the manner described above, the arc shifts onto the electrode 40 causing an internal short-circuit which shunts the downstream circuit and the alternistor 94. This alternistor 94 is thus protected against thermal stresses and can be of the electronic type which is easily controlable. The alternistor can constitute the neutral contacts.

Figure 9:
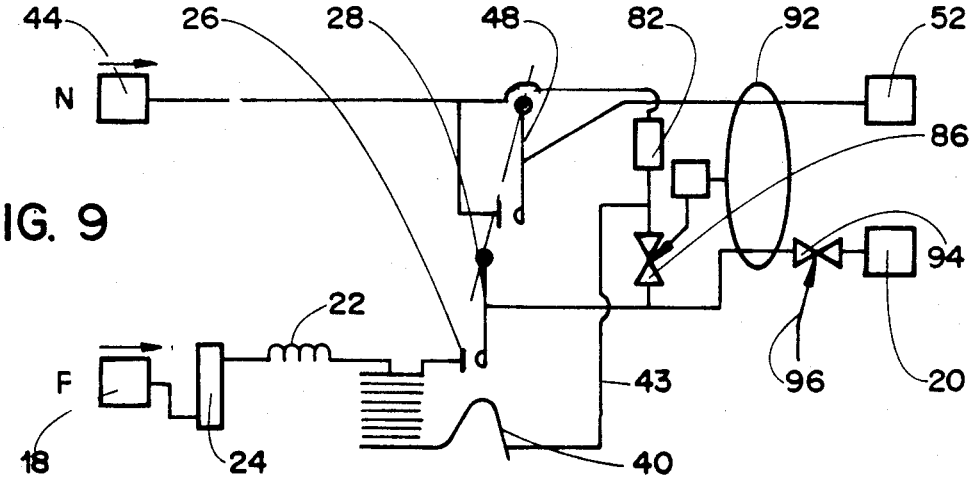

FIG. 9 illustrates a device including the improvements according to FIGS. 7 and 8 combined to provide both the circuit breaker function by means of the magnetic 22 and thermal 24 releases, the earth leakage protection function by means of the differential transformer 92 actuating the short-circuit simulation alternistor 86, and the contactor function by means of the alternistor 94 connected in series to the downstream circuit.

It is clear that the arrangements described more particularly with reference to one or other of the embodiments are also applicable to all the other embodiments.

What we claim is:

1. A low voltage electrical circuit breaker having:

a phase pole and a neutral pole, the phase pole comprising a first pair of contacts, first input and output terminals and a first connection circuit of said first terminals in which said first pair of contacts is inserted, said first pair of contacts being connected to the first input terminal, the neutral pole comprising a second pair of contacts, second input and output terminals and a second connection circuit of said second terminals in which said second pair of contacts is inserted, an arc chute being associated only with said first pair of contacts and not with said second pair of contacts;

a first operating mechanism for manual opening and closing and automatic opening on a fault of said first pair of contacts;

an electrode disposed in proximity to and clear from said first pair of contacts so as to be insulated from the first pair of contacts in the closed position and to pick up a drwan arc, when said first pair of contacts open on a fault;

a shunt circuit connecting said electrode to said second input terminal to create a short-circuit connection between said first and second input terminals via the contact among said first pair of contacts, an arc, said electrode and said shunt circuit, said shunt circuit being adapted to shunt said second pair of contacts, as soon as the arc has been diverted onto said electrode and to limit the fault current flowing through said second pair of contacts; and a second operating mechanism for opening and closing of said second pair of contacts, disposed to give said second pair of contacts an electrodynamic withstand notably lower than that of said first pair of contacts.

2. The circuit breaker according to claim 1, comprising a single arc chute, associated with said first pair of contacts, said electrode belonging to said arc chute which is incorporated in said short-circuit connection to break this connection as soon as the arc has been blown out in the arc chute.

3. The circuit breaker according to claim 1, comprising a remote control device associated with said second operating mechanism for remote opening and closing of said second pair of contacts.

4. The circuit breaker according to claim 1, comprising a connecting device between said first and second mechanism to open said second pair of contacts after said first pair of contacts when the circuit breaker opens on a fault.

5. The circuit breaker according to claim 2, having a narrow modular casing and comprising a first and a second juxtaposed compartment, the first compartment containing said first pair of contacts, said first mechanism and the arc chute and the second compartment containing said second pair of contacts and the second mechanism.

6. The circuit breaker according to claim 5, having a remote control device housed in said second compartment.

7. The circuit breaker according to claim 1, comprising a single casing having a manual operating handle, said second pair of contacts being housed in said casing, in proximity to said handle.

8. The circuit breaker according to claim 1, comprising a switch, notably solid-state, connected in series with said first pair of contacts and downstream from the first pair of contacts to be protected from short-circuit currents by said shunt circuit.

* * * * *